United States Patent [19]

Louman et al.

[11] Patent Number: 4,670,183

[45] Date of Patent: Jun. 2, 1987

[54] METHOD AND COMPOSITIONS RELATING TO THE ACTIVATION OF FLUORESCENT WHITENING AGENTS

[75] Inventors: Hendrik W. Louman, Richterswil, Switzerland; Peter J. Corbett, Rheinmünster, Fed. Rep. of Germany

[73] Assignee: The Dow Chemical Company, Midland, Mich.

[21] Appl. No.: 671,528

[22] Filed: Nov. 14, 1984

[30] Foreign Application Priority Data

Nov. 15, 1983 [GB] United Kingdom ..... 8330404

[51] Int. Cl.[4] ..... C09K 11/02

[52] U.S. Cl. ..... 252/301.35

[58] Field of Search ..... 252/301.35

[56] References Cited

U.S. PATENT DOCUMENTS

| | | | |
|---|---|---|---|
| 3,326,814 | 6/1967 | Klaas | 252/301.35 |
| 3,666,680 | 5/1972 | Briggs | 252/301.35 |
| 4,238,384 | 12/1980 | Blumberg et al. | 252/301.35 |

*Primary Examiner*—Howard S. Williams

[57] ABSTRACT

A fluorescent whitening agent is activated using a polymer of a hydroxyalkyl (meth)acrylate such as poly(2-hydroxyethyl acrylate).

10 Claims, No Drawings

METHOD AND COMPOSITIONS RELATING TO THE ACTIVATION OF FLUORESCENT WHITENING AGENTS

The present invention relates to the use of a polymer of a hydroxyalkyl (meth)acrylate for activating a fluorescent whitening agent and to compositions comprising a fluorescent whitening agent and a polymer of a hydroxyalkyl (meth)acrylate.

For aesthetic and various other reasons, it is often desirable that a material such as a cloth, paper, plastic or paint appear white. Many common materials having a whitish color exhibit a yellowish tinge due to the fact that they have a reduced blue remission, i.e., the material remits less blue than the other colors throughout the spectrum. Therefore, to improve the apparent whiteness of the material, it is necessary to reduce this blue deficiency.

Heretofore, one method for improving the whiteness of a material involves bleaching. Although bleaching destroys the colored impurities contained in the material, it also tends to damage the material being whitened.

Another method for improving the whiteness of a material is by blueing or coloring said material. Unfortunately, this leads to a darkening or dulling of the material since it does not increase blue remission but rather absorbs some of the excess yellowness and reduces the over-all color remission.

The most effective method for increasing the whiteness of a material, particularly the fluorescent whiteness, is achieved through the use of a fluorescent whitening agent, also referred to as an optical brightening agent, which functions by absorbing UV-radiation such as from daylight and re-emitting it as visible blue light. Therefore, the blue deficiency is reduced, thereby increasing apparent whiteness. In fact, upon visual inspection, fluorescent whitened materials are generally rated whiter than physically white materials such as magnesium oxide which have essentially the same remission throughout the visible spectrum.

Many of the known fluorescent whitening agents such as the stilbene compounds and the coumarin and carbostyril compounds are very effectively employed by themselves for whitening cellulosic materials. However, the fluorescent whitening agents are not so effectively employed in whitening other materials such as polyesters, polypropylene, polystyrene and inorganic fillers such as calcium carbonate, clay and talcum. For example, in the filling and/or coating of paper with an aqueous dispersion containing a filler and/or a pigment such as clay, a fluorescent whitening agent is often employed to whiten the filler or pigment. Unfortunately, only that fluorescent whitening agent coming into direct contact with the cellulosic base paper is activated and the fluorescent whitening effect of the activated whitening agent is significantly reduced due to screening by the filler particles in the filled paper or by the coating layer on the paper web. In such cases, for effective whitening, it is necessary to employ the fluorescent whitening agent in combination with a separate activating material.

For example, the combination of a poly(vinylalcohol) and a fluorescent whitening agent is well known to effectively whiten most common materials. In general, compositions containing this combination are applied directly to the material being whitened from a dilute, aqueous solution. Alternatively, the material being whitened such as a clay filler is added to an aqueous solution containing the fluorescent whitening agent and poly(vinylalcohol) activator for subsequent application to the substrate being coated and/or treated. Unfortunately, paper coating colors and other coating slurries containing the poly(vinylalcohol) and the fluorescent whitening agent often exhibit relatively poor rheological properties such as excessive viscosity which can result in coagulation of the aqueous liquid composition and/or poor processability. Using a poly(vinylalcohol) having a molecular weight sufficiently low to impart desirable rheological properties to the aqueous liquid is known to reduce the ability of the polymer to act as an activator for the fluorescent whitening agents.

In addition, various modified cellulosics such as carboxymethylcellulose are also known as activators for fluorescent whitening agents. Unfortunately, the carboxymethylcelluloses are not as effective as activators as the poly(vinylalcohols). Specifically, at optimum concentrations, further whitening of the treated material is often desirable. Moreover, like poly(vinylalcohol), the carboxymethylcellulose materials are commercially available as powders which require a pre-solubilization step prior to use. This pre-solubilization operation is energy and time consuming and often results in a non-homogeneous dispersion.

In view of the stated deficiencies of the prior art, it is desirable to provide an improved method for activating a fluorescent whitening agent and a composition comprising a fluorescent whitening agent and an activator which does not exhibit the disadvantages possessed by the prior art compositions.

Accordingly, in one aspect, the present invention is a composition comprising a fluoroescent whitening agent and an activating amount of a polymer, including a copolymer, of a hydroxyalkyl (meth)acrylate.

In another aspect, the present invention is an improved method for activating a fluorescent whitening agent wherein the improvement comprises contacting the fluorescent whitening agent with an activating amount of a homopolymer of a hydroxyalkyl (meth)acrylate, a copolymer of two or more hydroxyalkyl (meth)acrylates or a copolymer comprising more than 70 weight percent, in polymerized form, of one or more hydroxyalkyl (meth)acrylates.

By the term "activating amount" it is meant that the hydroxyalkyl (meth)acrylate polymer is employed in an amount sufficient to enhance the fluorescence of the fluorescent whitening agent, thereby improving the fluorescent whiteness of the material treated with the fluorescent whitening agent. For example, in the preparation of a pigmented coating composition, the activator polymer is employed in an amount such that, when applied to paper or other substrate, the coating surface appears whiter under average daylight as specified by CIE as $D_{65}$ light than if no activator were present.

The combination of the fluorescent whitening agent and hydroxyalkyl (meth)acrylate polymer activator is usefully employed in the treatment of various substances such as polyesters, polyethylenes, polypropylene, polystyrenes, and fillers such as talc, calcium carbonate and clay. In addition to enhancing the fluorescent whiteness of a treated material which is dried, the fluorescence of a liquid containing a fluorescent whitening agent can also be enhanced by the polymer or copolymer of the hydroxyalkyl (meth)acrylate.

The combination of the fluorescent whitening agent and polymer activator are particularly useful in coating paper and in a particularly preferred embodiment, the present invention is a coating composition comprising an aqueous suspension of a pigment and/or filler, e.g., clay, having the fluorescent whitening agent and polymer activator dissolved in the aqueous suspending medium. The combination of the fluorescent whitening agent and polymer activator whiten the pigment and/or clay particles of the coating color, thereby whitening the paper coated with the coating color. The term "coating color" is used conventionally herein and refers to a coating composition such as is used in the production of coated papers.

In addition to enhancing the fluorescent whitening effect of the fluorescent whitening agent, the hydroxyalkyl (meth)acrylate polymer does not adversely affect the rheological properties of the described coating color or other aqueous liquid containing the whitening agent/polymer activator combination. Specifically, the viscosity increase imparted to the coating color or other aqueous liquid by the polymer is not significant. In fact, in many instances, for the proper application of the coating composition or other liquid solution to a substrate, an additional thickener or other rheology control agent may be employed. By using two components -one component as an activator and a second component as a thickener or rheology control agent —it is possible to modify each component independently of the other component to obtain a composition having the desired balance of properties. Therefore, the fluorescent whitening effect can easily be modified without adversely and significantly affecting the rheology of the composition. Specifically, the whitening effect can be maximized without the viscosity or other rheological properties exceeding the limits set by a particular application. Such limitation would develop if both properties were imparted to the coating composition by a single component such as in the coating composition described by EP 14 904. Moreover, since the polymer can be prepared as a material which is inherently dispersible or soluble in an aqueous liquid, no presolubilization step is required prior to use.

It is to be understood that although the primary application of the present invention is enhancing the whiteness of yellowish materials that are desirably white, the combination of fluorescent whitening agent and the polymer activator will cause a fluorescence of non-white materials.

The fluorescent whitening agents suitably employed in the practice of the present invention are those materials which are capable of increasing the apparent blue remission of a material in or on which they are applied by absorbing UV-radiation and by re-emitting visible blue light. Conventional fluorescent whitening agents are disclosed in Chapter III of Fluorescent Whitening Agents, edited by R. Anliker and G. Müller, published in 1975 by Georg Thieme Publishers Stuttgart.

Representative fluorescent whitening agents include the stilbene compounds such as 4,4'bis-((4,6-di-substituted-1,3,5-triazine 2-yl)amino)-stilbene-2,2'-disulfonic acid derivatives, i.e., (I)

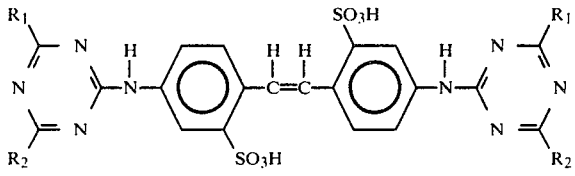

wherein $R_1$ can be

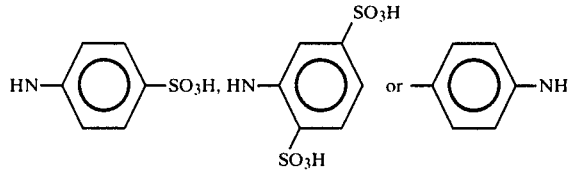

and $R_2$ can be $N(CH_2—CH_3)_2$, $N(CH_2—CH_2—OH)_2$ or

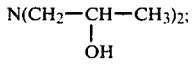

coumarin and carbostyril compounds such as

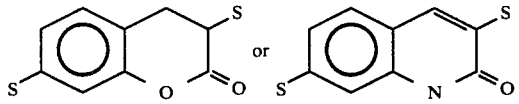

1,3-diphenyl-2-pyrazoline compounds such as

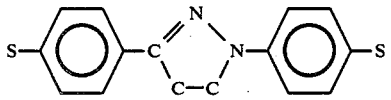

naphthalimide compounds such as

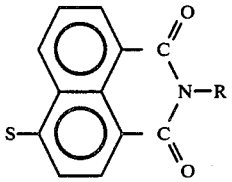

and benzazolyl substitution products such as

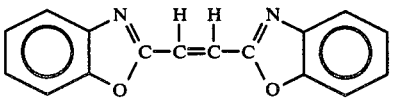

Of the various fluorescent whitening agents, due to their desired properties (e.g., water solubility), the silbene compounds, which were earliest described in U.S. Pat. Nos. 2,089,293 and 2,089,413, are generally most advantageously employed in the practice of the present invention as the fluorescent whitening agents, particularly as fluorescent whitening agents for detergents, soaps, textiles, photographic and other papers. In general, the most preferred stilbene compounds are stilbene compounds of the foregoing formula I wherein each $R_1$ is independently aniline, aniline sulfonic acid or aniline disulfonic acid and $R_2$ is independently diethylamine or diethanolamine.

The hydroxyalkyl (meth)acrylate polymers useful herein as the polymer activator for the fluorescent whitening agent are homopolymers of a hydroxyalkyl (meth)acrylate, copolymers of two or more hydroxyalkyl (meth)acrylates or copolymers comprising one or more hydroxyalkyl (meth)acrylate(s) and one or more, preferably one, other comonomer(s).

The hydroxyalkyl (meth)acrylate may comprise a hydroxyalkyl group containing from two to four carbon atoms. As used herein, the term "(meth)acrylate" is meant to designate both acrylates and methacrylates. Representative hydroxyalkyl (meth)acrylates useful in preparing the polymer activators are 2-hydroxyethyl acrylate, 2-hydroxyethyl methacrylate and hydroxypropyl acrylate. In general, the acrylates are more effective than the methacrylates in activating the fluorescent whitening agents and are more preferably employed herein. The most preferred hydroxyalkyl (meth)acrylate employed in preparing the polymer activator is 2-hydroxyethyl acrylate or a mixture of 2-hydroxyethyl acrylate and hydroxypropyl acrylate which mixture is employed to form a copolymer.

In addition to the hydroxyalkyl (meth)acrylate(s), the polymer activators useful in the practice of the present invention can also be a copolymer of a hydroxyalkyl (meth)acrylate with one or more, preferably one, copolymerizable monomers. The specific comonomer(s) and the amounts thereof employed in preparing the polymer activator are dependent on various factors including the specific comonomer employed, the desired hydrophilicity of the polymer activator and the desired capacity of the polymer to activate the fluorescent whitening agent.

For example, in many applications, polymers useful in the present invention are soluble or, at least inherently dispersible, in an aqueous liquid. By the term "inherently dispersible" it is meant that the acrylate polymers can be dispersed as colloidal size particles in an aqueous liquid to form a stable dispersion without the aid of additional emulsifiers or surfactants. By the term "aqueous liquid", it is meant water (including aqueous liquids such as alkaline or acidic solutions, e.g., an aqueous solution of calcium or sodium hydroxide, or aqueous salt solution) or a mixture of water and a water-miscible liquid, preferably a polar liquid such as a lower alkanol, e.g., methanol, ethanol or propanol; a lower ketone, e.g., acetone or methylethylketone; an ether, e.g., diethylether or diethylene glycol methylether; and the like.

If a polymer activator which is soluble in an aqueous liquid is desired, a comonomer which can be homopolymerized to form a water-soluble homopolymer, e.g., acrylamide or acrylic acid, can be employed at essentially any concentration to prepare a polymer having the desired solubility. However, since the comonomers tend to reduce the effectiveness of the hydroxyalkyl (meth)acrylate as an activator, the desired amount of comonomer employed is dependent upon obtaining the desirable capability to activate the fluorescent whitening agent. In general, if the hydroxyalkyl (meth)arylate is copolymerized with other comonomer(s), the resulting copolymer is advantageously derived from less than 30 weight percent of the comonomer and more than 70 weight percent of the hydroxyalkyl (meth)acrylate(s). However, the specific amounts vary depending on the specific comonomers.

For example, using acrylamide as a sole comonomer, a copolymer of 2-hydroxyethyl acrylate and acrylamide will activate the fluorescent whitening agent at acrylamide concentrations of up to 80 mole percent based on the total number of moles of polymerized monomer in the copolymer activator. The acrylamide comonomer is advantageously employed at concentrations of less than 75, preferably less than 60, mole percent and the 2-hydroxyethyl acrylate is employed in an amount of at least 25, preferably at least 40, mole percent, said mole percents being based on the total number of moles employed in preparing the activator polymer. However, the ability of the copolymer to activate decreases with increasing amounts of acrylamide employed in preparing the copolymer and the copolymer is more preferably prepared using less than 40 mole percent (30 weight percent) of acrylamide. Acrylic or methacrylic acid and other water-soluble monomers tend to have a greater effect on the ability of the copolymer to effectively act as an activator. Therefore, in general, the activator will be derived from less than 20, preferably less than 10, mole percent of the acrylic or methacrylic acid or other water-soluble comonomer.

Alternatively, to retain the desired water-solubility, comonomers such as ethyl acrylate which form water-insoluble polymers can generally only be employed in minor amounts, e.g., less than about 20, preferably less than about 10, most preferably less than about 5, mole percent. However, in certain instances, the polymer can be prepared as an insoluble material, in which case, slightly higher amounts of the water-insoluble comonomer can be used.

Preferred polymer activators include the homopolymers of 2-hydroxyethyl acrylate and 2-hydroxyethyl methacrylate and copolymers of 2-hydroxyethyl acrylate with 2-hydroxyethyl methacrylate, hydroxypropyl acrylate, up to 35 mole percent (25 weight percent) of acrylamide or up to 25 mole percent (13 weight percent) of acrylonitrile. Most preferred acrylate polymer activators are homopolymers of 2-hydroxyethyl acrylate.

The molecular weight of the hydroxyalkyl (meth)acrylate polymer activator is selected to provide the desired polymer properties, e.g., hydrophilicity, viscosity and degree of activity and end use application. As an example, for optimum activity and the ease of application from aqueous solution, the polymer activator is advantageously prepared at a molecular weight such that its viscosity as a 15 percent solution in water is at least 5 milli(Pascal.second) (mPas). The maximum molecular weight is not particularly critical to the practice of this invention and is dependent primarily on obtaining the desired solubility of the activator in the aqueous liquid. In general, the viscosity as a 15 percent solution in water is from 5 to 250, preferably from 10 to 100 mPas as measured by a Brookfield Viscometer, Model RVT with a UL adapter, at a suitable rpm and 20° C. These viscosity figures correspond to a Fikentscher K-value from about 2 to 55, with the preferred range being from about 25 to about 50, wherein the K-value is calculated from the relative viscosity at 20° C. as a 15 weight percent aqueous solution using the method of H. Fikentscher, Cellulose Chemie 13, 58–64 and 71–74 (1932).

Methods for preparing polymers and copolymers of a hydroxyalkyl (meth)acrylate are well-known in the art and reference is made thereto for the purposes of this invention. Illustrative polymerization techniques are described in U.S. Pat. No. 3,300,452 which is hereby incorporated by reference. In general, using the described techniques, the polymer activators are prepared by polymerizing in mass, in an aqueous or non-aqueous solution, the desired monomers using free-radical initiation means, including UV light, heat and/or one or more conventional chemical initiators such as a peroxygen, e.g., t-butylhydroperoxide, hydrogen peroxide and cumene hydroperoxide; a persulfate, e.g., potassium, sodium or ammonium persulfate; or a redox initiation system. Preferably, said polymerization is conducted in a solution of water or a mixture of water and a lower alcohol such as ethanol containing an effective amount of a chemical initiator by heating the aqueous, monomer-containing, solution to temperatures sufficient to polymerize the monomer. An effective amount of the initiator will typically range from 0.1 to 5 weight percent of the total weight of the monomers.

The hydroxyalkyl (meth)acrylate polymer is employed in an amount sufficient to activate the fluorescent whitening agent. This amount will vary depending on a variety of factors including the specific polymer activator and fluorescent whitening agent employed and the method of treating the material being whitened. In general, the polymer activator is employed in an amount such that the ratio of polymer activator to fluorescent whitening agent, on a weight basis, is from 100:1 to 1:1, preferably from 50:1 to 2:1.

In the practice of the present invention, the fluorescent whitening agent and polymer activator can be applied to the material being whitened by a variety of methods. Typically, the composition is applied from a liquid carrier, preferably an aqueous liquid, for the fluorescent whitening agent and polymer activator. Preferably, the fluorescent whitening agent and polymer activator are soluble in the liquid carrier.

For example, in one embodiment for treating a material using the present invention, the material is treated with a solution (including aqueous solutions, solutions in a mixture of water and an organic liquid, and solutions in an organic liquid) of the fluorescent whitening agent and polymer activator. In such embodiment, the solution will generally contain as little as 0.1 weight percent to as much as 60 weight percent of the combination of the whitening agent and polymer activator, with a solution of from 3 to 20 weight percent more typically being employed.

In one example of said embodiment, the fluorescence of a substrate such as a fiber, film or filled or coated paper can be enhanced by the direct application of a solution of the fluorescent whitening agent and polymer activator. Specifically, an aqueous or organic liquid or mixture of water and an organic liquid containing the polymer activator, fluorescent whitening agent and, optionally, other desirable adducts such as a thickener and/or a surfactant is applied directly to the fiber and film by known techniques. The solvent is subsequently removed from the substrate being treated by conventional techniques such as drying.

In a second example of this embodiment, the combination of fluorescent whitening agent and polymer activator is employed to whiten the filler and/or pigment contained by a paper coating color or a filler composition employed to fill a paper web. For example, in the coating of paper, the coating color will typically comprise an aqueous suspension containing from 10 to 80 weight percent, based on the total weight of the coating color, of fillers and/or pigments including clay and optionally, other mineral or synthetic fillers or pigments such as chalk, calcium carbonate or polystyrene. In addition, the coating color will conventionally contain a polymeric binder in an amount of up to 75 weight percent, based on the total weight of the fillers and/or pigments. Polymeric binders are well known in the art. Representative polymeric binders are set forth in German Pat. Nos. 1,546,316; 1,221,748 and 1,264,945 and EP Patent Applications, Publication No. 93,206; all of which are incorporated herein by reference. The polymeric binders preferably employed herein are copolymers of styrene, butadiene and, optionally, an $\alpha,\beta$-ethylenically unsaturated carboxylic acid; or copolymers of an ester of an $\alpha,\beta$-ethylenically unsaturated carboxylic acid such as butyl or ethyl acrylate and a comonomer which forms a water-insoluble homopolymer such as vinyl acetate.

If desired, other adjuncts such as dispersing agents, adhesives, lubricants or thickeners or rheology control agents, can be employed. To effectively whiten the fillers and/or pigments contained by the coating color, the desired amounts of the fluorescent whitening agent and activator polymer are dissolved in the aqueous phase of the coating color prior to the application of the coating to paper. In general, the desired amounts of the fluorescent whitening agent are those amounts employed heretofore in commercial applications and typically range from 0.01 to 1.5, preferably from 0.03 to 1 parts of the fluorescent whitening agent per 100 parts, by weight, of the total filler and pigment.

To obtain the desired activation without deleteriously affecting the coating operation, while retaining the foregoing proportions of polymer activator and fluorescent whitening agent, the coating color advantageously contains up to 10, preferably from 0.5 to 5, more preferably from 1 to 4 parts of the polymer activator per 100 parts, by weight, of the total filler and pigment.

Since the polymer activator does not normally affect the viscosity of a liquid carrier or the resulting composition significantly, to impart the desired viscosity and/or other rheological properties, the coating color will also comprise a thickener and/or rheology control agent. For example, the composition can contain up to 5, preferably from 0.1 to 3, weight percent of a synthetic polymeric thickener such as the polymer thickeners described in U.S. Pat. No. 4,384,096. These synthetic polymer thickeners are typically prepared from an $\alpha,\beta$-ethylenically unsaturated carboxylic acid, preferably acrylic or methacrylic acid, a $C_1$–$C_4$ alkyl ester of an unsaturated carboxylic acid, preferably a $C_1$–$C_4$ alkyl acrylate, a methacrylate and, optionally other comonomers. Alternatively, but less preferably, the composition can contain up to 20 weight percent of other conventionally employed thickeners such as starch, cellulosics (e.g., sodium carboxymethyl cellulose, alginates, (e.g., sodium alginate)). Some of these thickeners may also activate the fluorescent whitening agent and this effect must be considered in subsequent formulation.

A convenient method for preparing the coating composition consists of pre-blending the polymer activator with the synthetic polymer thickener and then forming the coating composition containing the fluorescent whitening agent. The polymer activator and polymer thickener in the blend or mixture are advantageously employed in amounts such that from 0.1 to 50, preferably from 0.5 to 20 weight parts of the polymer activator are employed for each weight part of the polymeric thickener. A particularly preferred composition comprises from 0.6 to 10 weight parts of a homopolymer of hydroxyethyl acrylate for each weight part of the synthetic polymer thickener. The blend or combination of the polymer activator and synthetic polymer thickener are advantageously prepared, for many applications, in an aqueous liquid. The aqueous liquid/activator/thickener composition is advtangeously prepared at from 5 to 60, preferably at from 20 to 50, weight percent solids.

In another embodiment, the fluorescent whitening agent and polymer activator can be applied onto the surface or absorbed into a solid carrier such as a particulate detergent material. To subsequently whiten a substrate, the substrate and solid carrier material are stirred together in a liquid such as may occur in washing. For most effective whitening, this liquid is selected such that both the fluorescent whitening agent and polymer activator are soluble therein.

In yet another embodiment, the fluorescent whitening agent and polymer activator can be sequentially applied to the material being treated by initially applying the polymer activator to the substrate and subsequently applying the desirable fluorescent whitening agent. In such case, it is generally advantageous to employ a relatively higher amount of the polymer activator than if both the whitening agent and activator are being applied simultaneously from liquid solution. Moreover, the substrate, either coincident with or subsequent to the application of the fluorescent whitening agent, is contacted with a liquid in which both the fluorescent whitening agent and polymer activator are soluble.

Alternatively, the fluorescent whitening agent can be applied with the desired polymer activator subsequently being applied to the substrate being treated.

The following examples are set forth to illustrate the invention and should not be construed to limit its scope. In the examples, all parts and percentages are by weight on a dry basis unless otherwise indicated.

EXAMPLE 1

Preparation of Polymer Activator

A poly(2-hydroxyethyl acrylate) was prepared by mixing 150 parts of 2-hydroxyethyl acrylate with 850 parts of deionized water in a suitably sized reactor equipped with an agitator, nitrogen purge, reflux condensor, thermometer and heating and cooling means. The pH of the resulting mixture was adjusted to 6.9 using a sodium hydroxide solution. The polymerization mixture was heated to 30° C. and the reactor purged with nitrogen. A chemical redox initiation system comprising t-butyl hydroperoxide, sodium persulfate and sodium bisulphite were added to the polymerization mixture as polymerization initiators. The nitrogen purge was then stopped and the contents of the reactor allowed to exotherm without external heating or cooling. A peak temperature was reached after a few minutes. Thereafter, the polymerization mixture was maintained at about 80° C. for one hour. The resulting polymer solution was found to have a pH of 5.5, 13.2 percent solids, a viscosity of 13.2 milli (Pascal.seconds) (mPas) as measured using a Brookfield viscometer, model RVT, UL adapter at 100 rpm and 20° C. (Fikentscher K-value of 33 calculated using the relative viscosity of the solution as prepared).

Preparation of Latex Containing Clay Slurry and Coating Color

A latex containing clay slurry was prepared mixing 100 parts of Dinkie A clay, 0.3 parts of a mixture of a polyphosphate and acrylic type dispersing agent 10 parts (dry) of a carboxylated styrene/butadiene, in latex form, as a binder and sufficient amounts of water such that the resulting dispersion contained about 47 percent solid material. A coating color is prepared from the clay slurry by adding, with agitation, 1.6 parts of a 16.5 percent aqueous solution of a fluorescent whitening agent of an aniline/diethanolamine derivative of the stilbene compound hereinbefore designated by Formula I; 3 parts of poly(2-hydroxyethyl acrylate) as a polymer activator for the fluorescent whitening agent and 1 part of a thickener based on a copolymer of methacrylate acid, vinyl acetate and ethyl acrylate. The resulting coating color (Sample No. 1) containing the fluorescent whitening agent and polymer activator was applied to a wood-free bleached sulphite paper using wire wound rods to give a coat weight of 18 g/m$^2$. The coated paper was dried with hot air of 200° C. The whiteness of the thus coated paper was measured according to the so-called Berger method using the Ciba-Geigy Plastic White Scale as described in "Review Progress in Coloration" by R. Griesser, Vol. 11 (1981), ppg. 25–36. The calculated whiteness was found to be 134.

A series of coating colors were prepared using identical techniques except that the amount of the aqueous fluorescent whitening agent solution was varied from 0.8 to 5 parts based on 100 parts of the clay in the coating composition. Paper samples coated with the various compositions exhibited a whiteness of 120 or greater.

A coating color was also prepared using identical techniques except containing 1.6 parts of the aqueous fluorescent whitening agent solution and 2 parts of the poly(2-hydroxyethyl acrylate). Paper coated using said coating composition exhibited a whiteness, as measured by the aforementioned techniques, of 125. Paper coated with an identical coating color except containing 1 part of the poly(2-hydroxyethyl acrylate) activator exhibited a whiteness of 110.

COMPARATIVE EXAMPLE 1

Using the techniques of Example 1 in preparing Sample No. 1, a coating color containing 1.6 parts of the aqueous fluorescent whitening agent solution but no polymer activator was prepared. A paper coated with this composition (using techniques identical to that employed in Example (1) was found to have a whiteness of only 95. Still lower whiteness values, between 82 and 91, were exhibited by papers coated with one of a series of coating colors containing 0.8, 3.2 and 5 parts based on 100 parts of the clay of the aqueous fluorescent whitening agent solution and no polymer activator.

COMPARATIVE EXAMPLE 2

To a latex containing clay slurry identical to that prepared in Example 1 were added 1.6 parts of an aqueous fluorescent whitening agent solution identical to that employed in Example 1 and one part of fully hydrolyzed poly(vinylalcohol) with a solution viscosity of 4 mPas as a 4 percent solution in water (added as 10 parts of 10 percent aqueous solution). Using the techniques described in Example 1, a paper was coated with the resulting composition. The whiteness of the coated paper was measured to be 111.

Paper coated with an identical composition except containing 2 parts of the poly(vinylalcohol) exhibited a whiteness of 131. Similarly, a whiteness of 144 was exhibited by a paper coated with an identical composition except containing 3 parts of the poly(vinylalcohol). In addition, a paper coated with an identical composition except containing 4 parts of the low molecular weight poly(vinylalcohol) exhibited a whiteness of 152. Slightly higher whiteness was exhibited when 3.1 parts of the fluorescent whitening agent solution were employed in the compositions containing 3 and 4 parts of the polyvinyl alcohol. Unfortunately, to obtain the required processability to coat paper with a coating color having a high solids content (i.e., greater than 55 percent total solids) for an extended period of time, the maximum amount of the poly(vinylalcohol) which can be incorporated within the described coating color was approximately 1 percent. Therefore, although exceptional whiteness can be obtained using the poly(vinylalcohol) activator, its use is limited in industrial operations.

COMPARATIVE EXAMPLE 3

To a latex containing clay slurry identical to that prepared in Example 1 were added 1.6 parts of an aqueous fluorescent whitening agent solution identical to that of Example 1 and 4 parts of a carboxymethylcellulose with a degree of substitution (D.S.) of 0.9 and a viscosity of 5 mPas as a 2 percent solution in water (added as 40 parts of a 10 percent aqueous solution). Using the techniques described in Example 1, paper was coated with the resulting composition. The coated paper exhibited a whiteness of about 120.

When an identical composition was prepared except containing 3 parts of the carboxymethylcellulose, the coated paper exhibited a whiteness of 106.

Paper coated with an identical composition except containing 2 parts of the carboxymethylcellulose exhibited a whiteness of about 101. A whiteness value of 99 was obtained when paper was coated using an identical composition except containing 1 part of the carboxymethylcellulose activator.

The whiteness found using the carboxymethylcellulose activator was clearly less than using the poly(2-hydroxyethyl acrylate) as an activator. Moreover, the whiteness obtainable using the carboxymethylcellulose activator was limited due to the fact that the carboxymethylcellulose increases the viscosity of the coating color and no more than about 1.5 percent of the carboxymethylcellulose, based on the weight of the clay, can be employed while continuing to maintain desirable rheological properties of the coating color.

EXAMPLE 2

A coating color (Sample No. 2) was prepared by mixing clay slurry identical to that of Example 1 except containing no latex binder with one part of a 22 percent aqueous solution of the aniline/diethanol amine derivative of Formula I as the fluorescent whitening agent, 3 parts of a poly(2-hydroxyethyl acrylate) as a polymer activator and 1 part of a thickener based on methacrylic acid, vinyl acetate and ethyl acrylate. This composition was applied to a transparent sheet of polyester film using wire wound rods to achieve a uniform layer of a dry weight of 25 g/m$^2$. The sheets were immediately dried over a drum which was heated to 105° C. The polyester film was employed since, unlike the cellulosic paper, it has no ability to activate the fluorescent whitening agent. Therefore, background effects, if any, were eliminated. The fluorescence of the coating on the polyester film was determined using a remission photometer manufactured by Carl Zeiss equipped with a Zenon illuminator. The difference ($\Delta$UV) between the apparent remission of the coating - at 457 nm wavelength - when illuminated directly by $D_{65}$ light as compared to $D_{65}$ filtered through a barrier filter to shield all Xenon radiation below 420 nm (thereby excluding the exitation radiation of the fluorescent whitening agent) was found to be 7.7.

A series of identical compositions are prepared identical to Sample No. 2 except containing 1, 2, 5 or 10 parts of the polymer activator. Each composition was applied to a polyester film and the $\Delta$UV of each coated film was measured. The $\Delta$UV for the film coated with the composition containing 1 part of the polymer activator was 4.7. As the level of polymer activator increased, the fluorescence increased, with the $\Delta$UV of the film coated with the composition containing 10 parts of the polymer activator being 9.6. Alternatively, when an identical composition except containing none of the polymer activator is applied to the polyester film using the same techniques, the $\Delta$UV difference is found to be only 1.6.

COMPARATIVE EXAMPLE 4

An identical coating composition to Sample No. 2 of Example 2 except containing no thickener and 3 parts of the poly(vinylalcohol) employed in Comparative Example 2 in place of the poly(hydroxyethylacrylate) was applied to the polyester film using the techniques described in Example 2 and found to exhibit a $\Delta$UV difference of 8.1. Although this indicates that the poly(vinylalcohol) is slightly more effective in activating the fluorescent whitening agent then the acrylate polymer activator, such increased whiteness can only be obtained at the expense of the processability of the coating color. Moreover, as the amounts of the activator were increased, the differences in $\Delta$UV were reduced between films coated with the compositions containing the acrylate polymer activator and films coated with the compositions containing the poly(vinylalcohol).

A coating prepared from a composition identical to that of Example 2 except containing no thickener and 3 parts of the carboxymethylcellulose activator of Comparative Example 3 in place of the acrylate polymer activator exhibited a $\Delta$UV of only 3.3.

EXAMPLE 3

A coating composition (Sample No. 3) identical to Sample No. 2 of Example 2 except containing no thickener was coated on a polyester film. The coated film exhibited a $\Delta$UV of 7.1. Film coated with an identical composition except containing 2 parts of the poly(2-hydroxyethyl acrylate) exhibited a $\Delta$UV of 5.3. When coated with identical compositions containing 5 or 10 parts of the homopolymer activator, the fluorescence ($\Delta$UV) of the coated film was 8.3 and 9.1, respectively.

A copolymer was derived from 80 parts of 2-hydroxyethyl acrylate and 20 parts of hydroxypropyl acrylate using the polymerization techniques of Example 1. A composition identical to that of Sample No. 3 was prepared except using this copolymer in place of the 2-hydroxyethyl acrylate homopolymer as the activator for the fluorescent whitening agent. When coated on a polyester film, the fluorescence of the coated film was found to be 6.5. The fluorescence of a polyester film coated with an identical composition except containing 2 parts of the copolymer activator was 5.7. When coated with identical compositions containing 5 or 10 parts of the copolymer activator, the fluorescence of the resulting, coated polyester films was 8.0 and 8.8, respectively.

Similar results were obtained with identical compositions except containing 2, 3, 5 or 10 parts of a copolymer derived from 50 parts 2-hydroxyethylacrylate and 50 parts of hydroxpropylacrylate as the copolymer activator, with fluorescence values of the coated polyester films ranging from 5.5 to 8.5.

As evidenced by this Example, a copolymer of 2-hydroxyethyl acrylate and hydroxypropyl acrylate compares favorably in activity to a homopolymer of 2-hydroxyethyl acrylate.

A poly(hydroxyethyl methacrylate) is prepared using the techniques of Example 1 except using a mixture of 90 percent water and 10 percent ethanol as the polymerization mixture. A composition identical to that of Sample No. 3 is prepared except containing a poly(hydroxyethyl methacrylate) as an activator in place of the poly(2-hydroxyethyl acrylate). The fluorescence of a polyester film coated with this composition was shown to be about 70 percent of that found with the film coated with the composition (Sample No. 3) containing poly(2-hydroxyethyl acrylate) copolymer activator.

EXAMPLE 4

A poly(2-hydroxyethyl acrylate) was prepared by the methods of Example 1. Fifty parts of the resulting acrylate polymer were mixed with fifty parts of an alkali-soluble thickener which is prepared as an emulsion ("latex") of a copolymer derived from 40 parts of methacrylic acid and 60 parts of ethyl acrylate.

A coating color was prepared by mixing 100 parts of Dinkie A clay, 0.3 parts of a mixture of a polyphosphate and acrylic type dispersing agent, 1.3 parts of a 16.5 percent aqueous solution of a fluorescent whitening agent of an aniline/diethanolamine derivative of the stilbene compound designated hereinbefore by Formula I and 3 parts of the 50:50 mixture of poly(2-hydroxyethyl acrylate):methacrylic acid/ethyl acrylate copolymer (1.5 parts of poly(2-hydroxyethyl acrylate)).

Using the techniques of Example 1, the coating color was applied at a coating weight of 18 g/m$^2$ to a woodfree bleached sulfite paper. The whiteness of the coated paper was 114.3 as measured using the Berger method described in Example 1.

COMPARATIVE EXAMPLE 5

A terpolymer was prepared in accordance with EP Publication No. 0 014 904 from 50 parts of 2-hydroxyethyl acrylate, 20 parts of methacrylic acid and 30 parts of ethyl acrylate. The resulting polymer exhibited a Fikentscher value of 110.0 as measured from its relative viscosity as a 0.5 weight percent aqueous solution.

A coating color was prepared identical to that of Example 4 except that 3 parts of the 2-hydroxyethyl acrylate/methacrylic acid/ethyl acrylate copolymer (1.5 parts of poly(2-hydroxyethyl acrylate per 100 parts of clay) were employed in place of the mixture of the poly(2-hydroxyethyl acrylate) and the alkali soluble thickener. In such manner, the coating colors of Example 4 and Comparative Example 5 contained the same amounts of polymerized 2-hydroxyethyl acrylate, methacrylic acid and ethyl acrylate with the difference being that in Example 4 two polymers were prepared from the three monomers whereas in Comparative Example 5 only one polymer was prepared from the three monomers.

Using the identical techniques of Example 4, a woodfree bleached sulfite paper was coated using the resulting coating color. The whiteness of the coated paper was only 99 which is significantly less than the whiteness of the paper coated with the coating color of Example 4.

A series of coating colors were prepared using the mixture of the poly(2-hydroxyethyl acrylate) and the alkali soluble thickener of Example 4 or the 2-hydroxyethyl acrylate/methacrylic acid/ethyl acrylate terpolymer of Comparative Example 5 at various concentrations between 1 and 5 weight parts per 100 parts of clay. In all instances, at the same concentrations, the whiteness of a paper coated with the coating color containing the polymer mixture of Example 4 was higher than the whiteness of a paper coated with the coating color containing the terpolymer of Comparative Example 5. Although these differences were relatively small at lower concentrations, (whiteness values of 89 to 87.5 at concentrations of 1 percent), at higher concentrations, the differences in whiteness increased. Specifically, paper coated with a coating color containing 5 percent of the mixture prepared in Example 4 exhibited a whiteness of 127.5 whereas paper coated with a coating color containing 5 percent of the terpolymer of Comparative Example 5 exhibited a whiteness of only 106.

EXAMPLE 5

Seventy parts of a poly(2-hydroxyethyl acrylate), prepared by the methods of Example 1, were mixed with 30 parts of an alkali soluble thickener which is prepared as an emulsion (latex) of a copolymer derived from 33 parts methacrylic acid and 67 parts of ethyl acrylate.

A coating color identical to that of Example 4 was prepared except that 3 parts of the polymer mixture of 70 parts poly(2-hydroxyethyl acrylate) and 30 parts of the alkali-soluble thickener were employed in place of the 50:50 poly(2-hydroxyethyl acrylate):thickener mixture.

The resulting coating color was applied to a woodfree bleached sulfite paper at a coating weight of 18 g/m$^2$ using the coating techniques of Example 1. The whiteness of the coated paper was 121.

Using an identical coating color except containing 1 part of the polymer mixture, the whiteness of the coated paper was 93 whereas the whiteness of a paper coated using a coating color containing 5 parts of the mixture was 133.

COMPARATIVE EXAMPLE 6

A terpolymer was prepared in accordance with EP Publication No. 0 014 904 from 70 parts of 2-hydroxyethyl acrylate, 10 parts of methacrylic acid and 20 parts of ethyl acrylate. The resulting polymer exhibited a Fikentscher value of 84.2 as measured from its relative viscosity as a 0.5 weight percent aqueous solution.

In all instances, paper coated with a coating color prepared using the resulting copolymer exhibited significantly lower whiteness values than paper coated with a coating color containing an equivalent amount of the blend of Example 5.

Using a coating color containing 1 part of the copolymer, the resulting coated paper exhibited a whiteness of 88.5 as compared to the whiteness value of 93 reported in Example 5. The whiteness of a paper coated with a coating color containing 3 parts of the copolymer is only 109 as compared to the whiteness value of 121 found in Example 5 for paper coated with an identical coating color except containing the polymer mixture. Paper coated using a coating color containing 5 parts of the copolymer exhibited a whiteness of 123 as compared to a whiteness of 133 reported in Example 5 for paper coated using an identical coating color except containing 5 parts of the polymer mixture.

Comparative Examples 5 and 6 were repeated except using hydroxypropyl acrylate in place of 2-hydroxyethyl acrylate. In all instances, paper coated with a coating color containing a terpolymer of (2-hydroxyethyl acrylate)/methacrylic acid/ethyl acrylate exhibited greater whiteness values than identical paper coated with an identical coating color except containing a terpolymer of hydroxypropyl acrylate/methacrylic acid/ethyl acrylate.

Moreover, a comparison of the results set forth in Example 4 with the results set forth in Comparative Example 6 shows that the whiteness of a paper coated with the 50:50 mixture of poly(2-hydroxyethyl acrylate); alkali soluble thickener is also, in all instances, greater than the whiteness of a paper coated with a terpolymer derived from 70 parts of 2-hydroxyethyl acrylate, 20 parts ethyl acrylate and 10 parts of methacrylic acid when the mixture and terpolymer are employed at equivalent levels.

EXAMPLE 6

An acrylate polymer activator was derived from 75 parts of 2-hydroxyethyl acrylate and 25 parts of acrylamide using the techniques of Example 1 except employing a sodium persulfate initiator rather than the redox initiation system. A composition identical to Sample No. 3 of Example 3, except containing the resulting 2-hydroxyethyl acrylate/acrylamide copolymer in place of the poly(2-hydroxyethyl acrylate) homopolymer as the polymer activator for the fluorescent whitening agent was subsequently prepared. When coated on a polyester film, the fluorescence of the coated film, as expressed in ΔUV, was found to be about 91 percent of the fluorescence exhibited by the polyester film coated with the coating color containing 3 parts of poly(2-hydroxyethyl acrylate). The film coated with an identical composition except prepared using a copolymeric activator derived from 50 parts (62 mole percent) of acrylamide and 50 parts (38 mole percent) of 2-hydroxyethyl acrylate exhibited a fluorescence which is about 75 percent of that exhibited by the film coated with a composition containing poly(2-hydroxyethyl acrylate) activator. Although, due to the interaction of the clay and polymerized acrylamide, the viscosity of the coating colors containing the 2-hydroxyethyl acrylate/acrylamide was generally higher than that of a coating color composition containing 2-hydroxyethyl acrylate homopolymer, the copolymers are shown to be effective activators. This viscosity increase was not evident in a water based system containing no clay.

When polyester film is coated with an identical composition except containing a copolymeric activator derived from 90 percent (80 mole percent) of 2-hydroxyethyl acrylate and 10 percent (20 mole percent) acrylonitrile which polymer is soluble in the coating composition, the fluorescence of the resulting coated film is 91 percent of the value obtained when using a poly(2-hydroxyethyl acrylate) activator. Even stronger fluorescence (approximately 97 percent) was obtained when the polyester film was coated with a copolymeric activator derived from 95 percent (90 mole percent) of hydroxyethyl acrylate and 5 percent (10 mole percent) of acrylonitrile. Alternatively, film coated with an identical composition except containing a copolymeric activator derived from 75 percent (58 mole percent) of 2-(hydroxyethyl acrylate) and 25 percent (42 mole percent) of acrylonitrile which polymer was prepared as a dispersion rather than a solution exhibited a fluorescence which was approximately 74 percent of the fluorescnce exhibited by film coated with an identical composition containing a poly(2-hydroxyethyl acrylate) activator.

The fluorescence of polyester films coated with identical compositions except having copolymeric activators derived from 2-hydroxyethyl acrylate and one of styrene, ethylacrylate, methacrylic acid or acrylic acid decreased relatively rapidly as the percentage of the comonomer was increased. Specifically, when only 10 parts of methyacrylic acid or acrylic acid were employed in preparing the copolymer activator, the fluorescence exhibited by a film coated with the composition containing either of the resulting copolymeric activators was only 57 percent of the fluorescence exhibited by a film coated with an identical composition except having a poly(2-hydroxyethy acrylate) activator. Although film coated with a composition containing a copolymeric activator prepared using 5 percent styrene or ethyl acrylate exhibited a fluorescence of approximately 88 percent of the fluoresence exhibited by a film coated with the composition of Example 3, when 15 percent of the styrene or ethyl acrylate was employed in preparing the copolymeric activator, the fluorescence exhibited by the film was about 60 percent of the fluorescence exhibited by paper with compositions containing the poly(2-hydroxyethyl acrylate) activator.

EXAMPLE 7

A coating composition identical to that of Sample No. 3 of Example 3 was prepared except that the clay is replaced by 39.2 parts of a plastic pigment of polystyrene spheres having an average particle size of 0.4 microns. Due to the difference in the densities between the clay (2.65 g/cm$^3$) and the polystyrene plastic pigment spheres (1.04 g/cm$^3$), the final coating compositions have the same volume concentration of the pigment/filler. To the resulting coating composition was added 1 part of a 22 percent aqueous solution of the fluorescent whitening agent employed in Example 3. A portion of this coating composition was subsequently applied to a polyester film using the techniques of Example 2. The fluoresence, as expressed in ΔUV, of the resulting film is 1.1.

To another portion of the coating composition containing the fluorescent whitening agent is added 1 part of a poly(2-hydroxyethyl acrylate) prepared using the techinques of Example 1. When the resulting composition is applied to a polyester film, the ΔUV is increased to 5.20.

A polyester film coated with a composition containing 2 parts of the poly(2-hydroxyethyl acrylate) activator exhibits a further increase in ΔUV to 8.37. Further increases in the ΔUV were exhibited by films coated using compositions containing 3, 5 and 10 parts of the poly(2-hydroxyethyl acrylate) copolymer activator. Specifically, the film coated with the composition containing 3 parts of the activator exhibited a ΔUV of 10.7, the film coated with the composition containing 5 parts of the poly(2-hydroxyethyl acrylate) exhibited a ΔUV of 12, whereas the film coated with the composition containinq 10 parts of the poly(2-hydroxyethyl acrylate) activator exhibited a ΔUV of 12.66.

Similar increases in ΔUV were also exhibited when calcium carbonate, talc, and other plastics were employed as the filler/pigment in the coating composition. If titanium dioxide was used as the filler/pigment in the coating composition, the effect of the polymer activator was not significant since titanium dioxide is a strong UV absorbing material. Specifically, the activating effect of the polymer could not be determined due to the strong UV absorbance of titanium dioxide, which prevented fluorescence of the fluorescent whitening agent.

EXAMPLE 8

An aqueous solution containing 7.5 grams of a 22 percent aqueous solution of the fluorescen whitening agent employed in Example 7 per liter of water was applied to so-called "heat-bonded" polypropylene non-woven web by immersing the web into the solution for approximately 5 seconds, squeezing the impregnated web by hand and then air drying the web. The treated web was then folded four times and tested for fluorescence (ΔUV) and whiteness. (A non-woven, polypropylene web tested in this manner exhibited a fluorescence of 0 and a whiteness of 73.3). The ΔUV was found to be 1 and the whiteness was found to be reduced to 39.8 using the techinques exemplified in Example 1 due to the self-quenching of the non-activated fluorescent whitening agent.

An identical aqueous solution except containing 27.5 grams of a poly(2-hydroxyethyl acrylate) activator per liter of solution was applied to the polypropylene non-woven web, the fluorescence of the thus treated web was found to be 10.6 and the whiteness 166.4, both being a desirable increase.

Another aqueous solution containing 3.75 grams of the 22 percent active solution of the fluorescent whitening agent and 13.75 parts of the polymeric activator per liter solution was applied to a polypropylene non-woven web. The treated web showed a fluorescence of 7.3 and a whiteness of 135.1, indicating that the poly(2-hydroxyethyl acrylate) polymer activator is useful in activating the fluorescent whitening agent even at this lower concentration.

A polypropylene web was washed with another aqueous solution containing 27.5 grams of the polymeric activator (no fluorescent whitening agent being employed) per liter solution and further treated as described before in this Example. The washed polypropylene non-woven web showed a fluorescence value of 0 and a whiteness of only 74.4.

In each of the above-described formulations, 0.068 grams of a surfactant per liter solution were added to each of the compositions being an amount sufficient to reduce the surface tension of the composition to about 34 dynes per centimeter in order to improve the wettability characteristics of each composition.

EXAMPLE 9

A coating color was prepared by adding 0.96 parts, per 100 parts of clay, of a 23.6 percent aqueous solution of an aniline sulfonic acid/diethanol amine derivative of the compound hereinbefore designated by Formula (I); 3 parts of a poly(2-hydroethyl acrylate), and 1 part of a thickener based on a copolymer of methacrylic acid, vinyl acetate and ethyl acrylate to a latex containing clay slurry identical to that employed in Example 1. The resulting coating was applied to a wood-free bleached sulphite paper using wire wound rods to give a coat weight of 18 g/m$^2$. The coated paper was dried with hot air of 200° C. The whiteness of the thus coated paper was 127. The whiteness of a paper coated with an identical coating color containing no polymer activator was 81.

The whiteness of a paper coated with an identical coating color except containing 2 parts of the poly(2-hydroxyalkyl acrylate) was 119 whereas the whiteness of a paper coated with an identical coating color except containing 1 part of the poly(2-hydroxyalkyl acrylate) was 103.

COMPARATIVE EXAMPLE 7

A coating color was prepared by adding to a latex containing clay slurry identical to that prepared in Example 1, 0.96 part of a 23.6 percent aqueous solution of the aniline sulfonic acid/diethanol amine derivative of the compound designated (I), three parts of a carboxymethylcellulose having a D.S. of 0.9 and a viscosity of 5 mPas as a 2 percent solution in water. Using the techniques described in Example 9, a paper was coated with the resulting composition. The whiteness of the coated paper was measured to be 117.

Paper coated with an identical composition except containing 2 parts of the carboxymethylcellulose exhibited a whiteness of 112. A whiteness of 97 was exhibited by a paper coated with an identical composition except containing 1 part of the carboxymethylcellulose.

As shown by these examples, the poly(2-hydroxyethyl) acrylate is again shown to a more effective activator than the carboxymethylcellulose as the same concentrations.

EXAMPLE 10

A coating color was prepared by adding 1.6 parts, per 100 parts of clay, of a 15.5 percent aqueous solution of an aniline disulfonic acid/diethyl amine derivative of the compound (I); 3 parts of a poly-(2-hydroxyethyl acrylate); and 1 part of a thickener based on a copolymer of methacrylic acid, vinyl acetate and ethyl acrylate to a latex containing clay slurry identical to that employed in Example 1. The resulting coating was applied to a wood-free bleached sulphite paper using wire wound rods to give a coat weight of 18 g/m$^2$. The coated paper was dried with hot air of 200° C. The whiteness of the thus coated paper was 135. The whiteness of a paper coated with an identical coating color containing no polymer activator was 95.

The whiteness of a paper coated with an identical coating color except containing 2 parts of the poly(2-hydroxyalkyl acrylate) was 131 whereas the whiteness of a paper coated with an identical coating color except containing 1 part of the poly(2-hydroxyalkyl acrylate) was 121.

COMPARATIVE EXAMPLE 8

A coating color was prepared by adding to a latex containing clay slurry identical to that prepared in Example 1, 1.6 part of a 15.5 percent aqueous solution of the aniline disulfonic acid/diethyl amine derivative of the compound designated (I), three parts of a carboxymethyl cellulose having a D.S. of 0.9 and a viscosity of 5 mPas as a 2 percent solution in water. Using the techniques described in Example 7, a paper was coated with the resulting composition. The whiteness of the coated paper was measured to be 113.

Paper coated with an identical composition except containing 2 parts of the carboxymethylcellulose exhibited a whiteness of 110. A whiteness of 107 was exhibited by a paper coated with an identical composition except containing 1 part of the carboxymethylcellulose.

As shown by these examples, the poly(2-hydroxyethyl) acrylate is again shown to a more effective activator than the carboxymethylcellulose at the same concentrations.

What is claimed is:

1. A composition comprising a fluorescent whitening agent and an activating amount of (1) a homopolymer of a hydroxyalkyl(meth)acrylate, or (2) a copolymer of two or more hydroxyalkyl (meth-)acrylates, or (3) a copolymer comprising more than 70 weight percent, in polymerized form, of one or more hydroxyalkyl (meth)acrylate(s)

whereby said composition appears whiter than in the absence of said (1), (2), or (3).

2. The composition of claim 1 wherein the ratio of the polymer activator to the whitening agent is 100:1 to 1:1 and the composition further comprises an aqueous liquid carrier in which the fluorescent whitening agent and polymer activator are soluble.

3. The composition of 5 wherein the liquid carrier is water and the aqueous solution contains from 0.1 to 60 weight percent of the fluorescent whitening agent and polymer activator.

4. The composition of claim 1 wherein the polymeric activator is a homopolymer of 2-hydroxyethyl acrylate or a copolymer of 2-hydroxyethyl acrylate and hydroxypropyl acrylate.

5. The composition of claim 1 containing from 10 to 80 weight percent based on the total weight of the coating color of fillers and/or pigments; up to 10 weight parts of the polymeric activator and from 0.01 to 1.5 weight parts of the fluorescent whitening agent per 100 weight parts of the fillers and pigments.

6. The composition of claim 5 wherein from 0.5 to 5 weight parts of the polymeric activator and from 0.03 to 1 weight part of the fluorescent whitening agent are employed per 100 weight parts of the fillers and pigments and the ratio of polymeric activator to fluorescent whitening agent is 50:1 to 2:1, and the composition further comprises from 4 to 35 weight parts of a copolymer binder per 100 weight parts of the fillers and pigments, and a thickener.

7. The composition of claim 6 wherein the thickener is a synthetic polymer thickener derived from an $\alpha,\beta$-ethylenically unsaturated carboxylic acid, a $C_1$–$C_4$ alkyl ester of an unsaturated carboxylic acid.

8. The composition of claim 7 wherein said thickener additionally comprises other comonomers.

9. A composition comprising a fluorescent whitening agent and a homopolymer of hydroxyethyl acrylate and a synthetic polymer thickener, the polymer thickener being employed in an amount of from 0.6 to 10 weight parts of acrylate homopolymer per weight part of synthetic polymer thickener.

10. A method for activating a fluorescent whitening agent with a polymeric activator which comprises contacting the fluorescent whitening agent with an activating amount of (1) a homopolymer of a hydroxyalkyl (meth)acrylate, (2) a copolymer of two or more hydroxyalkyl (meth-)acrylates or (3) a copolymer comprising more than 70 weight percent in polymerized form of one or more hydroxyalkyl (meth)acrylates.

* * * * *